US007845622B1

(12) United States Patent
Riggs

(10) Patent No.: US 7,845,622 B1
(45) Date of Patent: Dec. 7, 2010

(54) HOIST DEVICE

(76) Inventor: Allen Riggs, 222 S. East St., Hill City, KS (US) 67642

( * ) Notice: Subject to any disclaimer, the term of this patent is extended or adjusted under 35 U.S.C. 154(b) by 0 days.

(21) Appl. No.: 12/454,659

(22) Filed: May 22, 2009

(51) Int. Cl.
*B66D 1/00* (2006.01)
*B66D 1/36* (2006.01)
*B66C 23/44* (2006.01)

(52) U.S. Cl. ..... 254/326; 254/323; 254/285; 254/336; 212/180

(58) Field of Classification Search ..... 254/284, 254/285, 286, 323, 326, 336, 362, 398; 212/180, 212/238, 294
See application file for complete search history.

(56) References Cited

U.S. PATENT DOCUMENTS

| | | | | |
|---|---|---|---|---|
| 3,918,592 | A * | 11/1975 | Paul | 254/390 |
| 4,135,627 | A * | 1/1979 | McInerney | 212/299 |
| 4,383,792 | A | 5/1983 | Seabloom et al. | |
| 4,616,225 | A * | 10/1986 | Woudenberg | 340/908 |
| 4,806,063 | A * | 2/1989 | York | 414/462 |
| 5,520,498 | A * | 5/1996 | DiBartolomeo | 414/680 |
| 5,725,112 | A * | 3/1998 | Thorby | 212/180 |
| 5,788,095 | A * | 8/1998 | Watson | 212/180 |
| 5,971,177 | A * | 10/1999 | Carter | 212/177 |
| 6,138,991 | A | 10/2000 | Myers, Jr. | |
| 6,152,675 | A * | 11/2000 | Compton | 414/543 |
| 6,189,866 | B1 * | 2/2001 | Harkins et al. | 254/332 |
| 6,202,868 | B1 * | 3/2001 | Murray | 212/294 |
| 6,234,453 | B1 * | 5/2001 | Block | 254/285 |
| 6,250,483 | B1 * | 6/2001 | Frommer | 212/180 |
| 6,425,727 | B1 * | 7/2002 | Hood | 414/543 |
| 6,481,694 | B2 * | 11/2002 | Kozak | 254/325 |
| 6,599,078 | B1 * | 7/2003 | Elder | 414/542 |
| 6,869,265 | B2 | 3/2005 | Smith et al. | |
| 6,921,007 | B1 * | 7/2005 | Guerrant | 224/519 |
| 6,942,198 | B2 * | 9/2005 | Huang | 254/387 |
| 7,059,955 | B2 * | 6/2006 | Green et al. | 452/189 |
| 7,156,246 | B2 | 1/2007 | Sherrod | |
| 7,201,552 | B1 * | 4/2007 | Angel et al. | 414/462 |
| 7,244,173 | B2 * | 7/2007 | Lake | 452/128 |
| 7,374,388 | B2 | 5/2008 | Holt | |
| 7,575,120 | B2 * | 8/2009 | Beatty | 212/180 |
| 7,588,232 | B2 * | 9/2009 | Wei et al. | 254/337 |
| 7,624,967 | B1 * | 12/2009 | Doebler et al. | 254/272 |
| 2004/0026675 | A1 | 2/2004 | Green et al. | |
| 2004/0214515 | A1 | 10/2004 | Skarlupka | |

* cited by examiner

*Primary Examiner*—Evan H Langdon
(74) *Attorney, Agent, or Firm*—Robert E. Massa

(57) ABSTRACT

A hoist device adaptable to lift or pull load material of various types. The hoist device is attachable to the trailer hitch of a vehicle and comprises a telescopic boom of a pair of rectangular tubular members attachable slidably to a base support member. In adjacent position on the base support is a control post member to which other components are attached, including a motor-driven winch positionable on the upright end thereof. A lifting component is attachable to the end of the boom member to be able to rotate easily, in any direction, since the angular movement of the boom member is always only one direction in regard to the axis of the boom member. A cable is used to operate the movement of the boom member, and has one end attached to the winch and a second end attached to a rigid component on the boom member after engaging pulley means on the boom member or control post member as chosen to provide suitable angular orientation of the boom member and telescopic extension of the boom member.

12 Claims, 8 Drawing Sheets

HOIST DEVICE

FIELD OF THE INVENTION

My invention relates to a hoist device for lifting or pulling loads is particularly useful in the outdoor field by being attachable to a vehicle for portable movement thru standard attachment means. The hoist is particularly useful as a hoist for big game to lift the game to a convenient position while the game is being skinned and cleaned.

BACKGROUND OF THE INVENTION

Portable hoist equipment has become a very popular field of useful equipment, especially when needed for use with a great deal of the heavy items and equipment available today, and, as I found out, where special devices must be available to serve multiple purposes, for example, for moving heavy equipment and also being needed for handling big game.

Big game hunting, such as deer hunting, has a very definite need for hoist devices to lift or hold a large deer in a convenient arrangement while the hunter skins the animal and cleans the carcass for more convenient transport.

As I show with the hoist device I have developed, I soon came to realize that a practical form of hoist device could be useful for many purposes.

I have designed my hoist system basically as a powerful hoist system which can be easily and quickly disassembled of all its components for convenient storage, and so that a hoist may be very easily assembled from those numerous components with the use of very few nuts and bolts. The important characteristic of providing structural security during use is with the cooperation of pin members positioned thru chosen structural openings.

The major components are rectangular tubular components which are made to operate telescopically by the action of motor-driven cable and pulley connections.

The tubular components are preferably formed of ¼ inch thick steel members which are 2 to 3 inches wide and 7 to 10 feet long.

The uppermost component on the extension boom is formed with a round base member which is rotatable within the next lower member to provide complete horizontal rotatable adjustment for the hoisting operation.

The initial choice of alignment for the hoist device is chosen by the position of the vehicle, not by subsequent alignment of the hoist unit.

The winch member is a typical winch and includes the usual ratchet and brake component for full control of the winch.

I have designed the winch and cable system for operation of extension movement of the boom members, angular positioning of the boom, and, at the finish of a task, movement of the boom to the proper position for storage.

As I show, the angular orientation and telescopic extension of the boom members can be determined and is controllable by the manner in which the cable is attached and made to operate the various components.

I have made sure that the device is given significant mechanical advantage by the choice and placement of the system of pulleys.

Then, I have most importantly discovered, that the rotational member of the device can be easily and safely held in a good operational position by the frictional action of the components and the weight of the components without the need for any system of security, such as nuts and bolts.

The more I thought about a game hoist, the more I had become aware that a portable hoist should be able to serve many purposes.

To my knowledge, there has not been a hoist device similar to my system.

In accordance with the usual practice, I had conducted a patent search, as a result of which I found the following patents which were considered to be the closest to my invention.

U.S. Pat. No. 4,383,792 to Seabloom et al describes a detachable hoist mounted on the bed of a truck constructed from tubular members of square cross section. The hoist is mounted on a carriage which includes rollers so that it may move along tracks on the vehicle bed. To facilitate raising the boom, a strut is used to assist tension. After the boom is raised beyond a chosen angle, a guy wire is attached and the strut is removed. To handle loads at a greater distance, a second winch is added and placed in transverse operation. A second guy line is used to help raise the boom to retain the boom at the required angle. The boom does not appear to be horizontally pivotal.

U.S. Pat. No. 6,138,991 to Myers, Jr., describes a hoist apparatus mounted on a vehicle. Two embodiments of the hoist apparatus are shown, one embodiment is connected to the rear end of the vehicle and the second is connected to the foot reception area at a midpoint of the vehicle. A hand-operable winch is controlling a cable extending from winch around a pulley at the end of the boom to a hook member for lifting game. Boom is lockable in orientation by nut and bolt means securing members of support plate. Separate means are shown for safely locking the hook when the apparatus is not in use.

U.S. Pat. No. 6,250,483 to Frommer describes a field hoist which is mountable on a truck and comprises a vertical post with a hand-driven winch at the end thereof. An angled upright member is slidably positioned thereon. Both vertical component and angled member are telescopically extendible. The boom is rotatably positionable on the post to any chosen orientation and lockable at any extension by nut and bolt means thru cooperable holes. Various accessories may be positioned at the end of the boom, including a chair member.

U.S. Pat. No. 6,425,727 to Hood describes a hoist which is attached to the bed of a truck which includes a vertical mast which is rotatable about its axis and includes a telescopic boom swivelably connected to the lower end. A motor-driven winch is attached near the lower end of said boom and said boom includes holes which may be aligned to receive pins for locking securely. The hoist is designed to be operable from a position within the bed of a truck where it is always to be available.

U.S. Pat. No. 6,869,265 to Smith et al describes a lift device which is attachable to the cargo rack of an ATV. The device includes a vertical frame member attached to the vehicle having a horizontally extending base support member pivotally attached to the bottom of the vertical frame member. A motor-driven winch is mounted on the vertical frame member to operate a cable connected to the base support member to swing the base support swivelably with game loaded thereon in position to become unloaded upon a cargo rack on the ATV.

U.S. Pat. No. 7,156,246 to Sherrod describes a lift device which is retractably and rotatably mounted on an ATV and includes a horizontal base plate rotatably attached to ATV with a vertical member attached thereto and an extension plate pivotally attached thereto. A winch is positioned on the vertical member and operates a cable attached thereto which passes over a pulley at the end of an upper elongated boom component.

U.S. Pat. No. 7,374,388 to Holt describes a hoist apparatus which is attachable to a tow hitch of a truck, primarily for butchering large game. The device includes a folding tubular boom made of two sections which are locked in place at a swivel bracket and have a hand-driven winch at the midpoint thereof and have an extendible angular member forming the upper section. Then the upper section has a spreader bar at the end of the boom for supporting a deer and a stabilizer fits receivably into a portion of the spreader bar and a chain depends from each end of the spreader.

U.S. Provisional Application 2004/0026675 to Green et al describes a game hoist attachable to a receiver hitch on a vehicle which includes a telescopic boom rotatably attachable thereto. Telescopic action is provided by a ratchet member operable by a crank. A winch near the receiver hitch is operable by a hand crank.

U.S. Provisional Application 2004/0214515 describes a game hoist which is mountable on a truck by means of a horizontal member which supports a vertical member arranged to rotate around the vertical shaft, and which supports a motor-driven winch directing a cable for placement of a hook component along the shaft.

SUMMARY OF THE INVENTION

The primary object of my invention is to provide a powerful hoist system which can be easily and quickly assembled or disassembled despite the size and weight of the components.

It is another object of my invention to provide a hoist system which is easily attachable to a vehicle and adaptable to provide a lifting movement for a variety of load systems.

Still another object of my invention is to provide a hoist system which is adaptable for movement in chosen rotatable or angular positions for accepting a proper load.

Still another object of my invention is to provide a hoist system which is capable of lifting easily any size of game for cleaning and dressing.

Still another object of my invention is to provide a hoist system which includes a motor-driven cable system and further includes a portable motor control, Still another object of my invention is to provide a hoist system which is operable under significant mechanical advantage for easy operation.

I have always considered the cost of preparation and the ease of assembly to be the two most primary objects of my invention.

Therefor, I have worked toward the aim of developing and producing a game hoist which is capable of lifting and carrying practically any type of load which has to be lifted, positioned, carried, or loaded.

My initial thoughts involved the experience I had with the various types of game hoists I had noticed during my career as a deer hunter.

Then, as I eventually noticed, a proper hoist device could be constructed to be useful for lifting practically any type of object that must be handled in certain ways.

I soon found out, as I show in my drawings, that, with very little adaptation of the hoist device, the apparatus will be useful for many tasks.

As easily and clearly as I show in my description, one type of hoist is adaptable with a hook member at the end of a cable for listing large game, and another type of hoist has a chain member which is capable of being wrapped around a large movable object. Then, of course, I believe, many other types of attachments may be used as needed.

Further objects and advantages of my invention will become obvious from the following written description and drawings by which I have described important features of my invention.

DESCRIPTION OF THE PREFERRED EMBODIMENTS

Figure 1:
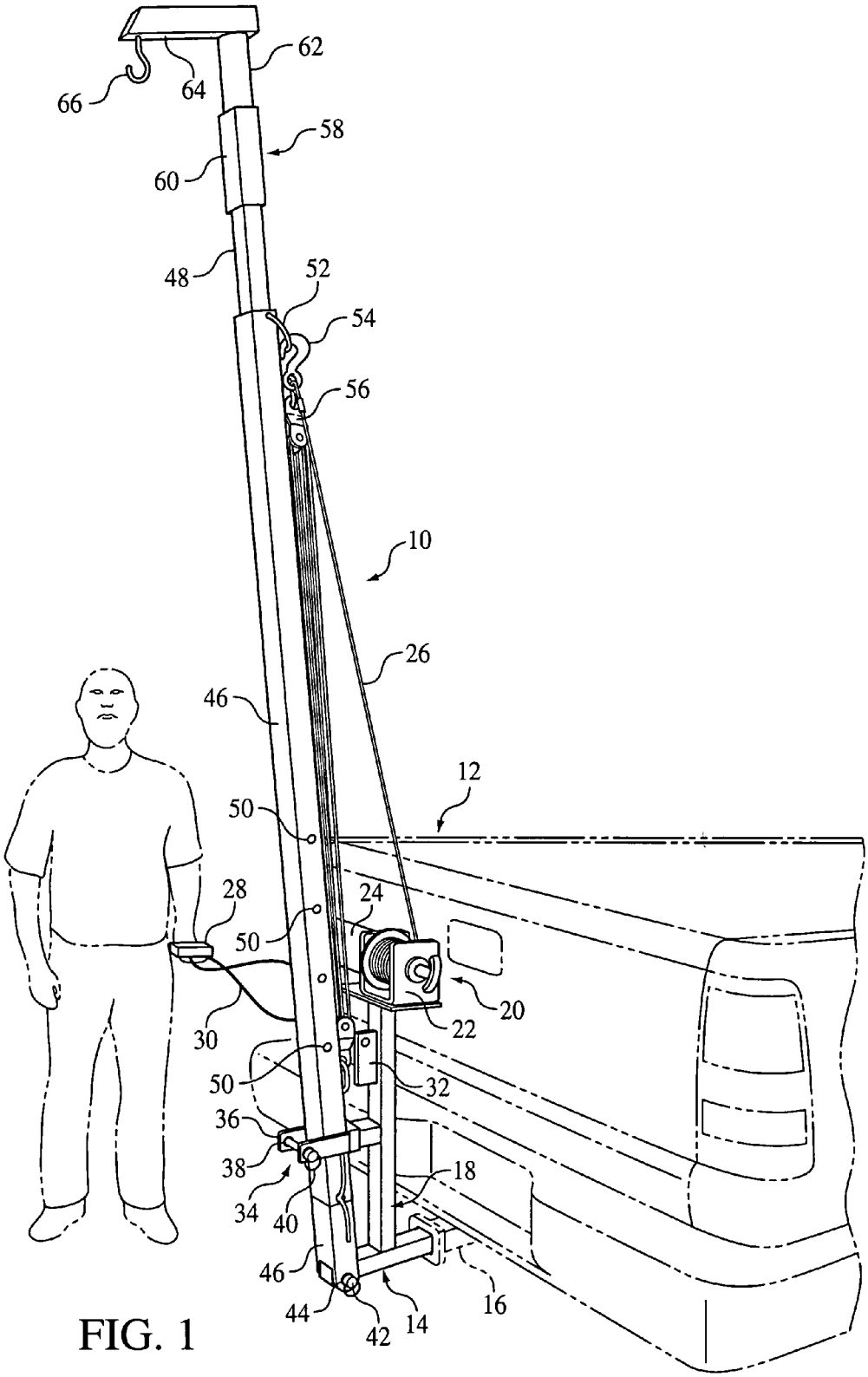
FIG. 1 is a perspective view of a hoist device of the invention as it would be attached to a vehicle in an unextended position and clamped securely thereto with the vehicle and operator shown in phantom and the operator holding the power control of the winch.

In FIG. 1 I describe one example of a hoist device according to my invention. I show my hoist device 10, generally, as it is attached to the rear of a vehicle 12, shown in phantom, by connection of a base support 14 to a trailer hitch 16. The base support 14 must be a sturdy component, preferably of rigid, rectangular tubular metal in order to support the heavy loads for which the hoist is presented. Secured to the upper side of base support member 14 I have secured a vertically extending control post member 18, provided of heavy duty, rectangular tubular metal to which other operating or security components of the hoist are attached. In effect, I consider the control post member 18 to be the centerpiece of the system, for both operation and security of the system. This is because I have placed a motorized winch assembly 20, generally, upon the upper end of control post member 18. The motorized winch assembly 20 comprises a winch member 22 which is driven by a motor 24 with the winch 22 supplied with cable 26 and with motor 24 controlled by a portable control member 28 connected to the motor 24 by wires 30. Thus, I show the portable motor control adaptable for placement where most suitable. Then, I have provided, on the side of the control post member 18, facing the hoist device 10, a connection plate 32 to provide a secure position for a pulley member as I show specifically in FIG. 4, as alternate placement of components.

For secure control of the hoise device during a time of moving or storage, I placed a clamp member 34, generally, which comprises a pair of side members 36, each of which includes an opening 38, adaptable to receive a pin 40 to provide a secure clamping action for keeping the hoist device in a sturdy, upright position.

Attached swivelably to the end of base support member 14, I have provided the telescoping boom members with a pin member 42 which passes thru cooperating holes 44 at the lower end of lower boom member 46 and similar holes (not shown) in the base support member 14. This arrangement permits the pair of boom members, lower boom member 46 and upper boom member 48, to have a full 90 degrees of arcing movement thru the vertical plane as determined by the position of the hoist. Both the lower boom member 46 and upper boom member 48 are of rectangular tubular metal, usually steel, approximately ¼ inch thick and preferably each 7 to 10 feet long slidably telescopic in a smooth movement, and each provided with a series of parallel openings 50, in the side walls, as chosen to provide locking security by insertion of standard pins thru cooperating openings.

In each of the figures I show a U-shaped connection member 52 secured near the end of lower boom member 46 to which a component, such as a hook member 54 may be attached for quick and easy assembly of the cable system, such as a first pulley 56 may be attached in a rigid manner in order to provide suitable mechanical advantage for the cable system.

Figure 6:
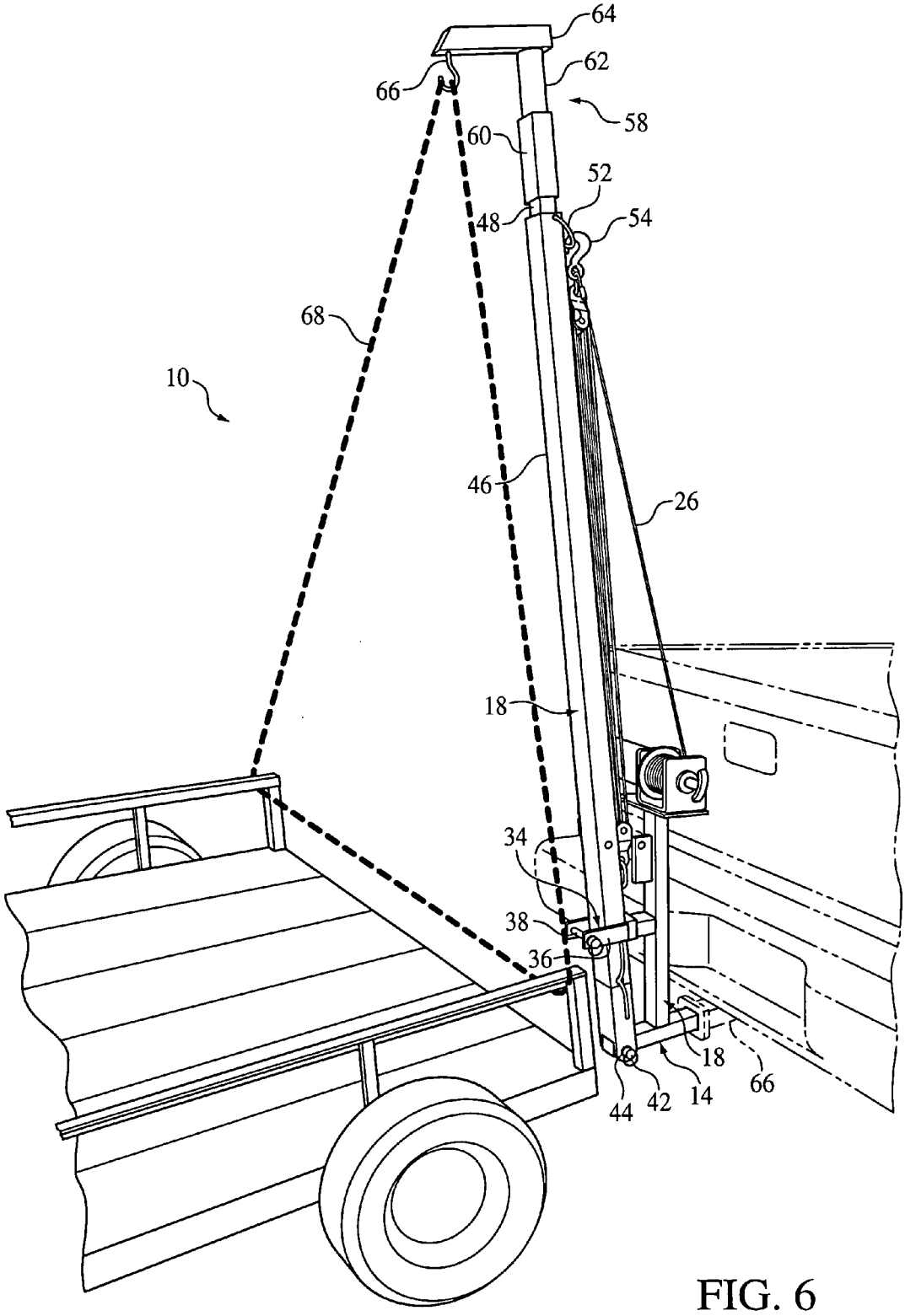
FIG. 6 is a perspective view of a hoist device of the invention as exemplified with a lifting component shown by a chain.

I have provided for rotatable movement for the lifting components of my hoist by the rotatable lifting component 58, generally, which comprises a short rectangular member 60 which fits slidably over upper boom member 48, and a round tubular member 62 which fits slidably within a round portion of rectangular member 62, and includes a short rectangular member 64 which extends a short distance outwardly from the hoist to give a suitable chosen position for a lifting component such as a hook member 66 or heavy duty chain 68 which I describe further in FIG. 6.

Figure 2:
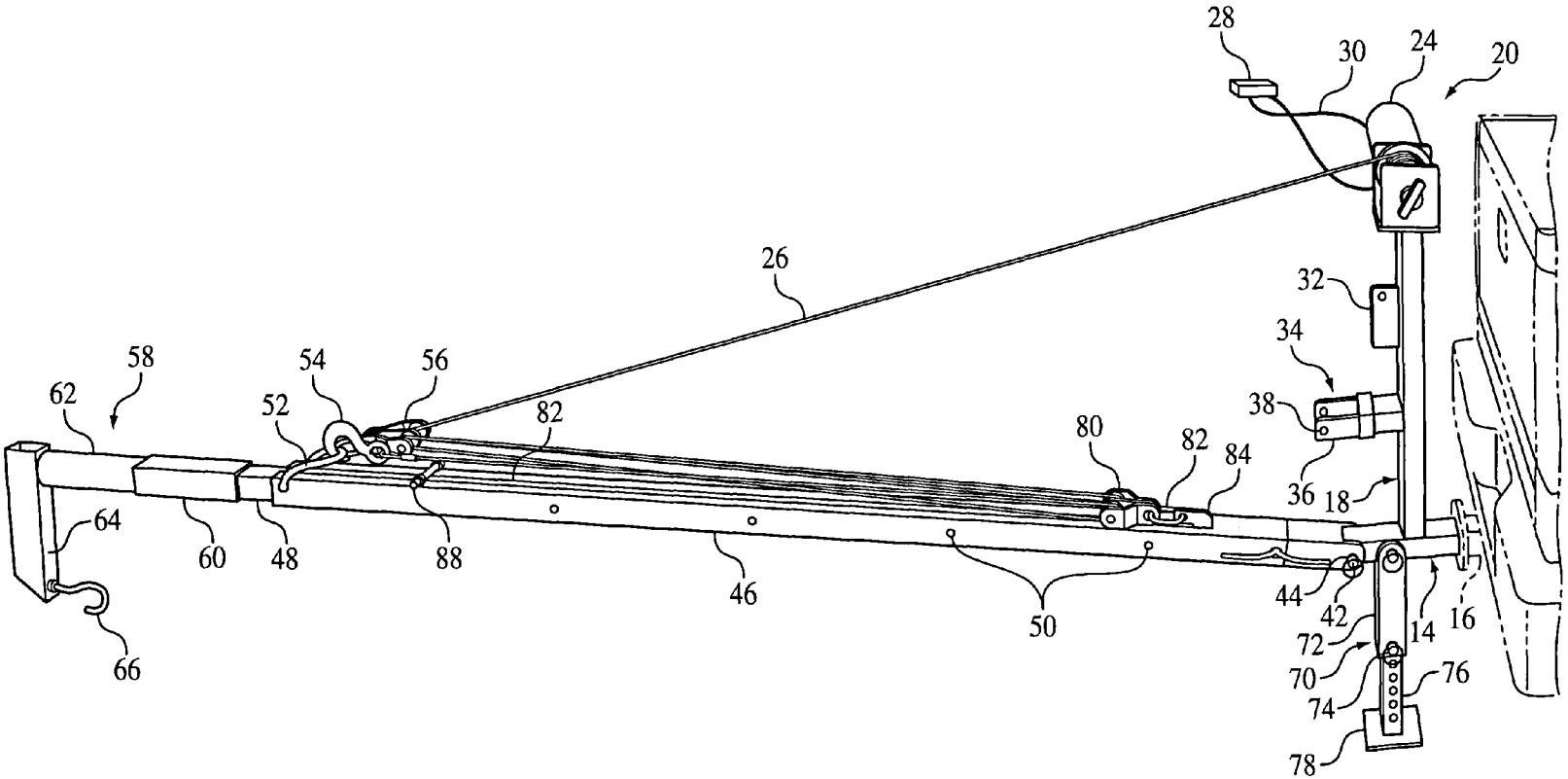
FIG. 2 is a perspective view of the hoist device of the invention after it has been released from the clamped position shown in FIG. 1 and is still in an unextended position but it now ready to be extended.

For extremely heavy loads, the hoist device 10 is given additional support by the provision of a ground support member 70, generally, as I show in FIG. 2, placed removably beneath base support member 14, and which includes a rectangular tubular member 72 attached to the base support member by a nut and bolt system 74 and an adjustable support member 76 secured to a plate member 78.

Figure 3:
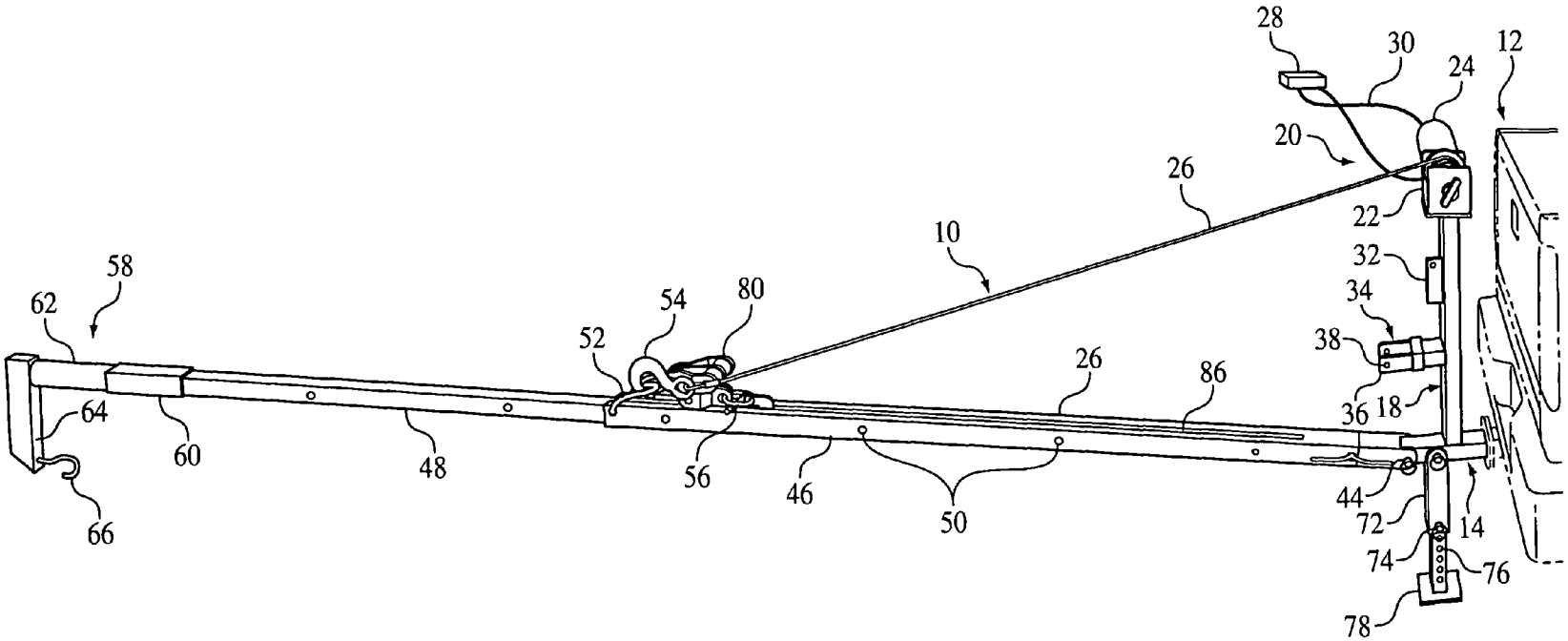
FIG. 3 is a perspective view of the hoist device of the invention showing the hoist of FIG. 2 as it is now in an extended position by the action of the motorized cable system connectible to the inner boom member to slide that boom to extension from, inside lower boom member. Also, to be extendible, the inner boom was freed from a pin-locking condition with the lower swivelable boom member.

In FIGS. 2 and 3 I describe the basic mode of operation and form of connection of the movable components of my invention to carry out that mode of operation.

In FIG. 2 I show the hoist device 10, generally, in a lowered, unextended position, ready for extension because a first pulley 56 is held by hook 54 in position with U-shaped connection 52 which is rigidly secured on lower boom member 46, and a second pulley member 80 is attached by a removable connection 82 to a small connection plate 84 which is securely connected to the upper boom member 48 and provides access to upper boom member 48 thru a channel 86 running lengthwise along lower boom member 46. With operation of the winch system and movement of cable 26, the upper boom member 48 is moved slidably to an extended position as I show in FIG. 3.

The upper boom member 48 may be allowed to rest in any position between unextended or fully extended. However, in a fully extended position, the second pulley 80 is brought to bear upon a removable pin stop 88 as I show.

Then, when the extension of the upper boom member 48 is completed and the second pulley 80 has reached the pin stop 88, if operation of the cable system continues, the boom members will be forced to move into a totally angularly orientation. The change of angular orientation can be achieved when the operator decides to provide pin stops at any place of cooperation with the boom members.

When the second pulley is held against a pin stop, the upper boom member 48 is held in this position mostly by the weight of the object being held and by the ease of keeping the cable taut and by the weight of the various components.

Figure 4:
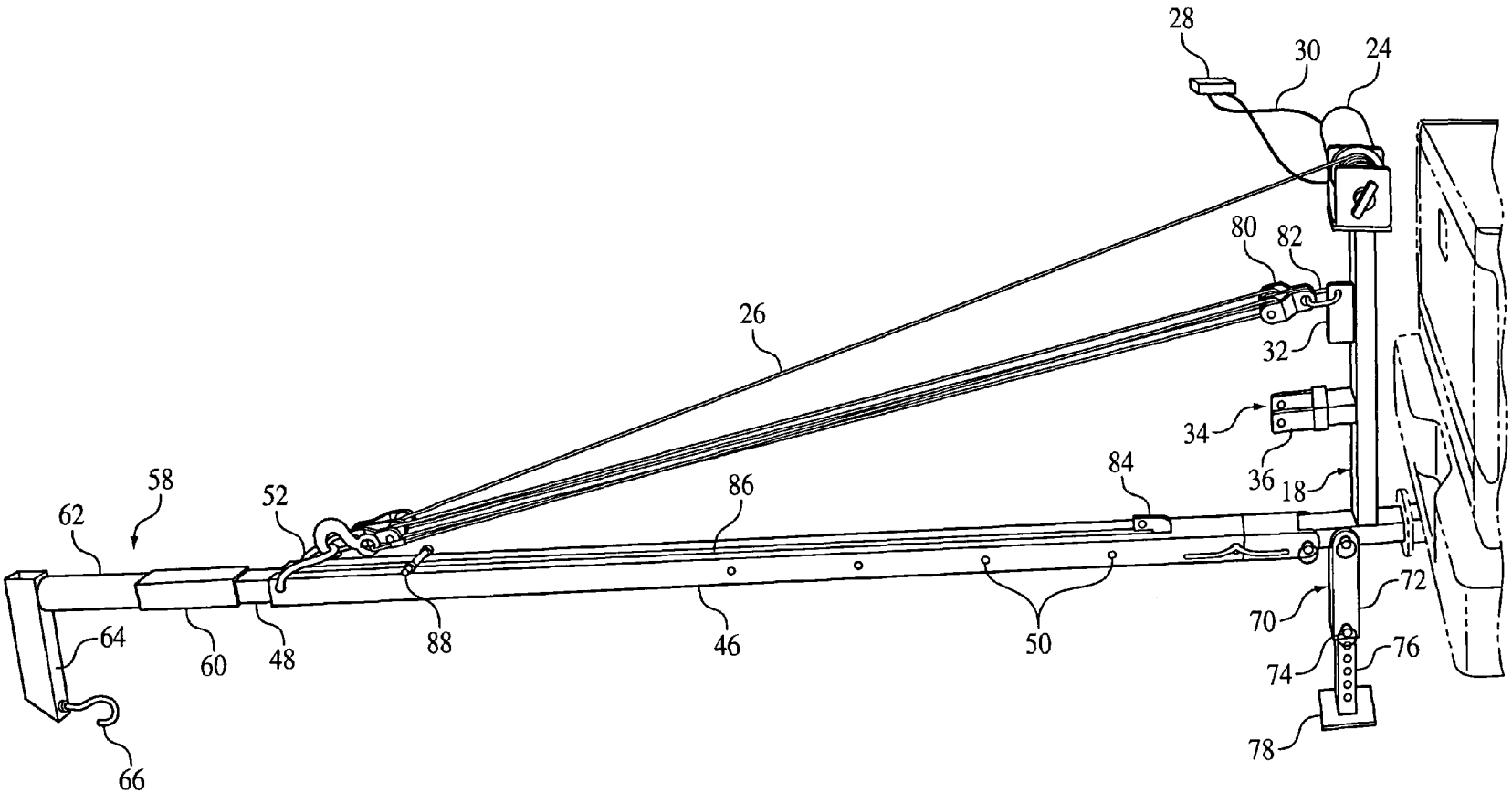
FIG. 4 is a perspective view of the hoist device of the invention showing the hoist in a closed and securely locked position and with a different pulley arrangement so that the boom member may be given an angular orientation by movement of the cable.
Figure 5:
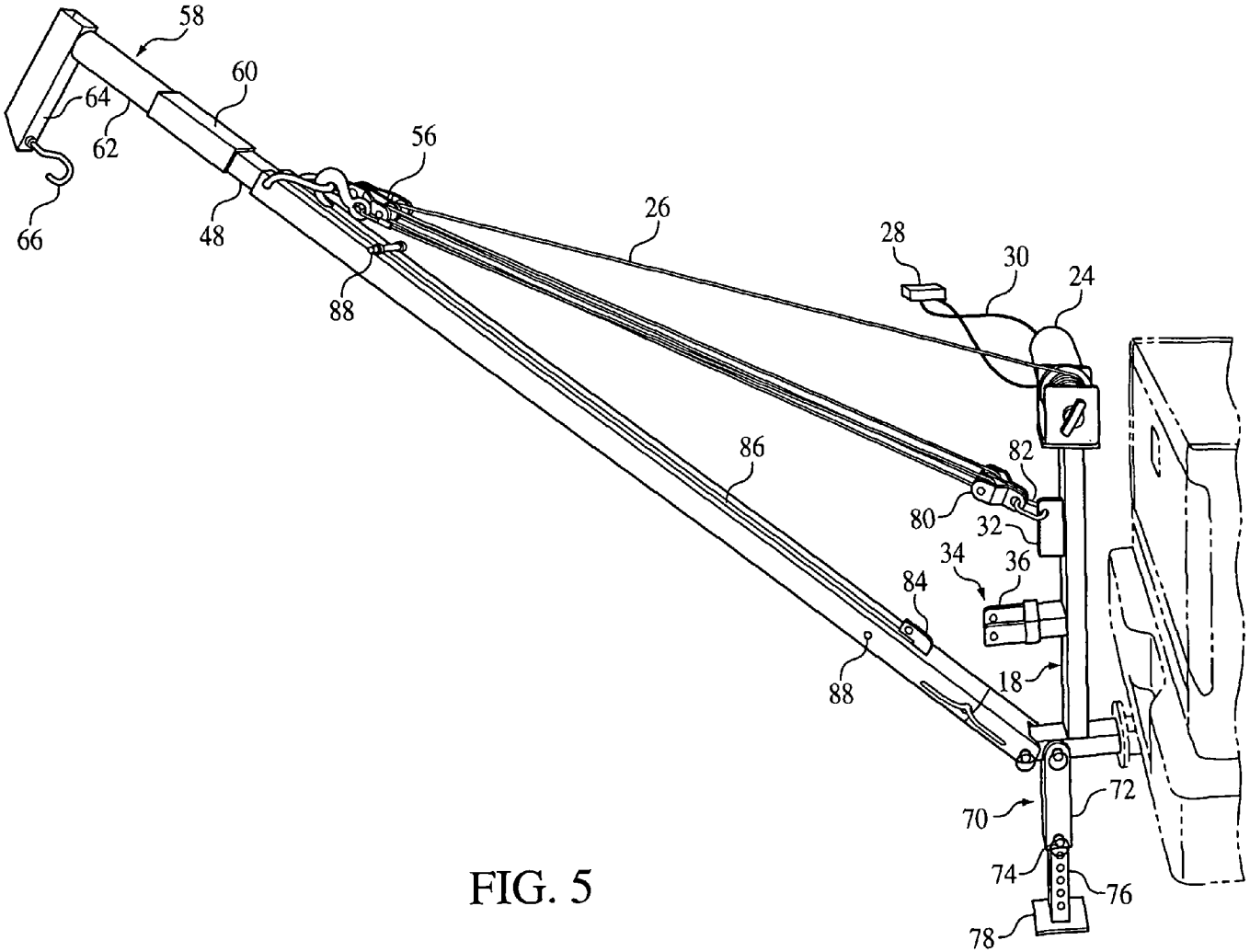
FIG. 5 is a perspective view of the hoist device of the invention showing the boom member in a different angular orientation from FIG. 4.

In FIGS. 4 and 5 I show the hoist device 10, generally, being placed in a different mode of operation. In this condition, I show the second pulley 80 being connected to connection plate 32 on the control post member 18 to provide a slightly different mechanical advantage for the operation of the hoist device 10 while maintaining the hoist device 10 in an unextended position.

In FIG. 6 I describe the hoist device 10 being used to lift a particularly heavy and cumbersome load by adaptation of a heavy-duty chain 68 in cooperation with the hook member 68.

Figure 7:
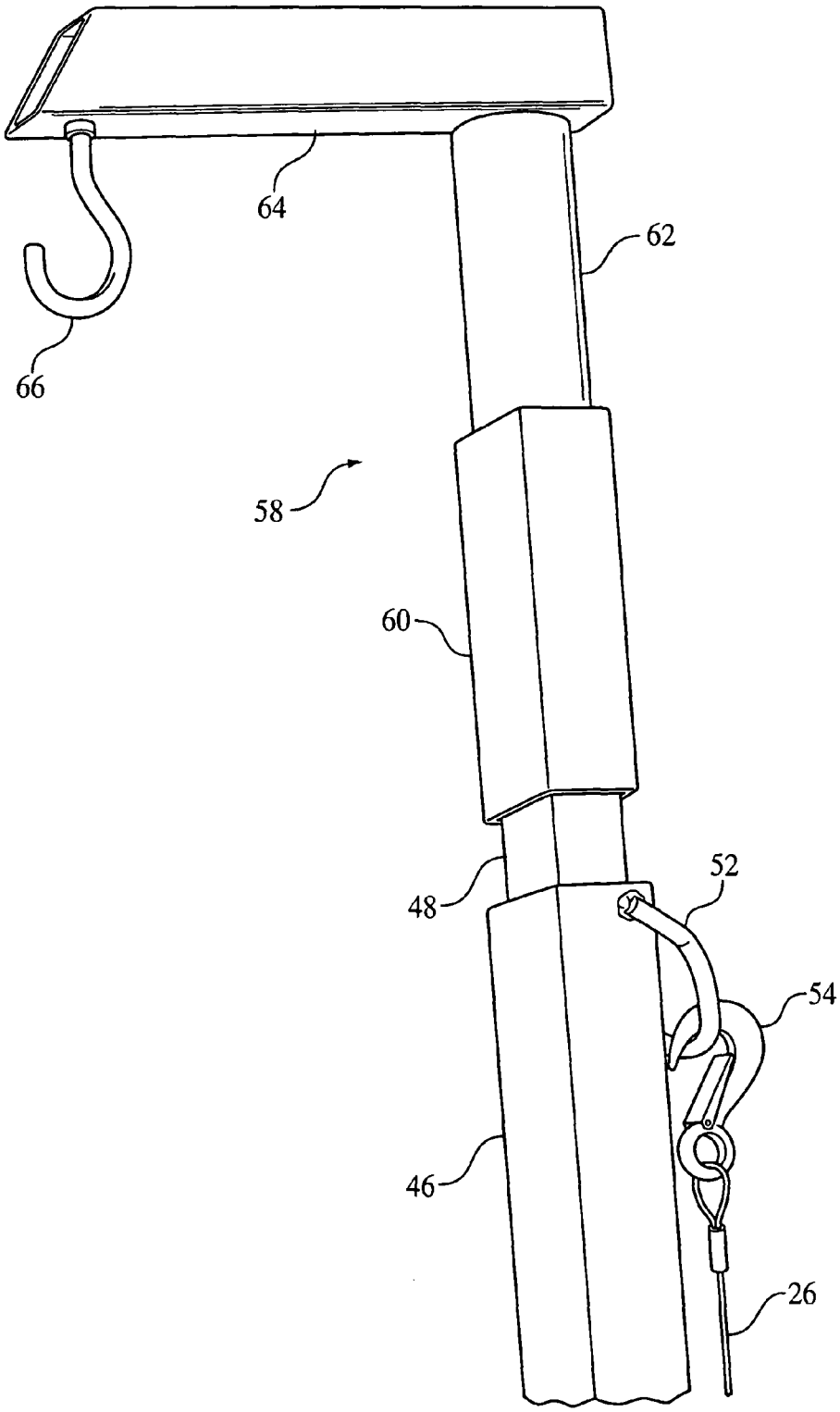
FIG. 7 is an isolated view of an uppermost member of the hoist device showing the rotatable component of the boom member.
Figure 8:
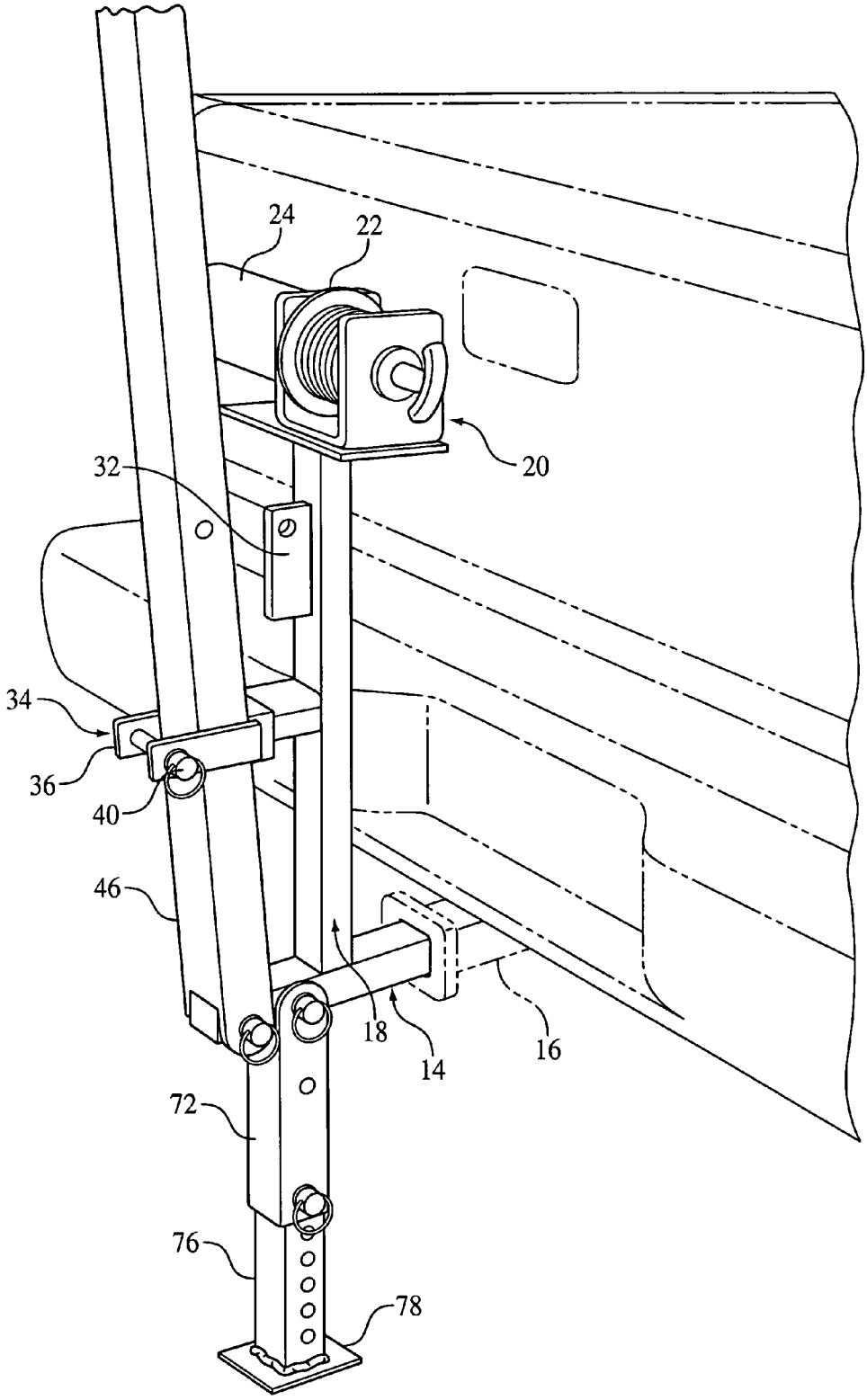
FIG. 8 is an isolated perspective view of a lower portion of the hoist device to show clearly the operable components.

I have provided FIGS. 7 and 8 merely to show more clearly those components which have already been described in detail.

Since many different embodiments of my invention may be made without departing from the spirit and scope thereof, it is to be understood that the specific embodiments described in detail herein are not to be taken in a limiting sense, since the scope of the invention is best defined by appended claims.

I claim:

1. A portable hoist device, comprising:

A base support member attachable to a vehicle trailer hitch, and

A telescoping boomember swivelably attachable at end of said base support member, comprising:

a lower member having a lengthwise channel therein and a connection member near upper end thereof for attaching a first pulley, and an upper member slidably eztendible within said channel having connection means thereon for attaching a second pulley, to provide a cable operable with said pulleys in a manner for providing telescopic movement of said lower and upper members, and angular orientation of said boom member, and A vertically extending control post member secured upon said base support member adjacent said telescoping boom member having:

a motor-driven winch secured at the top thereof for operation of said cable attachable to a connecting component of said hoist, and a clamp member positioned thereon facing said telescoping boom member to provide a clamping means for secure control of said boom member during moving or storing of said hoist, and a connection plate positioned thereon to provide alternate means of attachment for a pulley, and A rotatable positioning component at the end of said boom member having means for lifting a load attachable thereto.

2. A portable hoist device as described in claim 1, wherein:

Said lower boom member includes a lengthwise channel in the upper side thereof, and Said upper boom member includes a small connection plate near a lower end in a manner to extend thru said channel to provide connection means to said cable in operation of said system.

3. A portable hoist device as described in claim 2, wherein:

Said telescoping boom member includes means for securing said lower and upper members in stable extension position, and a pulley mounted on said boom member is responsive to said cable attached to the system.

4. A portable hoist device as described in claim 3, wherein:

Said means for securing said lower and upper members in stable extension comprises holes in opposite sides of boom members wherein a pin may be inserted thru the pair of opposite holes to provide security.

5. A portable hoist device as described in claim 4, wherein:

Said boom member is adaptable to be received within the clamp member on said control post member for storing or moving said device.

6. A portable hoist device as described in claim 5, wherein:

Said lower member further includes a loop member secured near the end thereof to provide a place for attachment of the cable.

7. A portable hoist device as described in claim 6, wherein:

Said rotatable positioning member comprises a combination of a vertical member having a round surface adaptable to cooperate slidably with a round surface of said upper boom member, and a horizontal extension at the top thereof with means for lifting a load attachable at an end of said horizontal extension.

8. A portable hoist device as described in claim 7, wherein:

Said round surface of said rotatable positioning member comprises an outer surface thereof, and said round surface of said upper boom member comprises an inner surface thereof, and said means for lifting a load comprises either a hook member or a chain.

9. A portable hoist device as described in claim 8, wherein:

Said vertically extending control post member includes a connection plate near the top to provide attachment for pulley means for further operation of said device.

10. A portable hoist device, comprising:

A base support member attachable to a vehicle trailer hitch, comprising a rectangular tubular member having connection means at an end thereof for receiving operating components, and A vertically extending control post member positionable upon said base support member having a motor-driven winch positionable upon a plate member secured at top of said control post member, with a clamp member near the top of said control post member in position to clamp a boom member, and a connection plate near the top thereof to provide a site for a pulley, and A telescoping boom component comprising a pair of rectangular tubular members, wherein:

a lower member is swivelably attachable to end of base support member and includes a lengthwise channel and a connection member near an end of said channel for attaching a pulley, and an upper member is slidably extendible within lower member and includes a connection plate secured thereto and is adaptable to extend outwardly thru the channel to provide connection for a cable, with both lower and upper members having alignable holes thru corresponding sides to accept a pin to provide security, and A rotatable positioning component at end of said boom comprising:

a rectangular tubular member positionable slidably upon upper end of boom member with an upper end forming a round tubular member, and an angularly orientably member extending outwardly from top of rectangular member, and a means for lifting a load is attachable at end of rectangular member and comprises either a hook member or a chain, and A first end of the cable is attached to said winch and a second end of the cable is attachable to an operating member of said device.

11. A portable hoist device as described in claim 10, wherein:

Said lower member of extendible boom component includes a first pulley member mounted thereon, and Said upper member of extendible boom component includes a second pulley member mounted thereon, and Said motor-driven winch is operably connected to the first end of the cable which is further operably connected to said first and second pulleys and to said means for lifting the load.

12. A portable hoist device as described in claim 10, wherein:

Said lower member of extendible boom component includes a first pulley member thereon, and A second pulley member is mounted on said control post member in connection to said connection plate when boom member is placed in a secure extension condition in order to provide means for placing said boom member in an altered angular position.

* * * * *